US008680029B2

(12) United States Patent
Habeeb et al.

(10) Patent No.: US 8,680,029 B2
(45) **Date of Patent: *Mar. 25, 2014**

(54) LUBRICATING OIL COMPOSITIONS FOR BIODIESEL FUELED ENGINES

(75) Inventors: Jacob J. Habeeb, Westfield, NJ (US); Ramesh Varadaraj, Flemington, NJ (US); Steven M. Jetter, Hightstown, NJ (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 234 days.

This patent is subject to a terminal disclaimer.

(21) Appl. No.: 12/892,630

(22) Filed: Sep. 28, 2010

(65) Prior Publication Data

US 2011/0082062 A1 Apr. 7, 2011

Related U.S. Application Data

(60) Provisional application No. 61/278,231, filed on Oct. 2, 2009.

(51) Int. Cl.
*C10M 169/04* (2006.01)

(52) U.S. Cl.
USPC ..... 508/110; 508/518; 508/531; 508/545

(58) Field of Classification Search
USPC ..... 508/110, 463, 518, 531, 545
See application file for complete search history.

(56) References Cited

U.S. PATENT DOCUMENTS

| | | | | |
|---|---|---|---|---|
| 3,336,124 | A | 8/1967 | Dunworth | |
| 3,903,002 | A | 9/1975 | Hotten | |
| 4,664,822 | A | 5/1987 | Hunt et al. | |
| 4,767,551 | A | 8/1988 | Hunt et al. | |
| 4,827,064 | A | 5/1989 | Wu | |
| 4,827,073 | A | 5/1989 | Wu | |
| 4,956,122 | A | 9/1990 | Watts et al. | |
| 5,451,333 | A * | 9/1995 | Waddoups et al. | 508/278 |
| 5,919,740 | A | 7/1999 | Bloch et al. | |
| 6,232,277 | B1 | 5/2001 | Ledeore et al. | |
| 6,270,538 | B1 | 8/2001 | Ledeore et al. | |
| 6,277,159 | B1 | 8/2001 | Caprotti et al. | |
| 6,821,932 | B2 | 11/2004 | Guinther et al. | |
| 7,179,311 | B2 | 2/2007 | O'Rear et al. | |

(Continued)

FOREIGN PATENT DOCUMENTS

| | | |
|---|---|---|
| GB | 1036384 | 7/1966 |
| WO | 2008056203 A2 | 5/2008 |

(Continued)

OTHER PUBLICATIONS

J. Andrew Waynick, "Evaluation of the Stability, Lubricity, and Cold Flow Properties of Biodiesel Fuel", 6th International Conference on Stability and Handling of Liquid Fuels, Vancouver, B.C., Canada, Oct. 13-17, 1997, pp. 805-829.

(Continued)

*Primary Examiner* — Taiwo Oladapo
(74) *Attorney, Agent, or Firm* — Robert A. Migliorini

(57) ABSTRACT

Lubricating oil used for the lubrication of engines run on biodiesel fuels are improved in their resistance to oxidation by the addition to said to lubricating oil of particular detergents, and premixed mixtures of particular detergents and anti-oxidants.

11 Claims, 3 Drawing Sheets

(56) References Cited

U.S. PATENT DOCUMENTS

| | | | | |
|---|---|---|---|---|
| 2001/0003734 | A1 | 6/2001 | Dunn | |
| 2003/0097783 | A1 | 5/2003 | Jordan | |
| 2003/0134756 | A1* | 7/2003 | Carrick et al. | 508/398 |
| 2004/0110104 | A1 | 6/2004 | Guinther et al. | |
| 2004/0152930 | A1 | 8/2004 | O'Rear et al. | |
| 2004/0254081 | A1 | 12/2004 | Guinther et al. | |
| 2005/0145831 | A1 | 7/2005 | Aldrich et al. | |
| 2006/0205615 | A1 | 9/2006 | Esche, Jr. | |
| 2006/0281643 | A1* | 12/2006 | Habeeb et al. | 508/192 |
| 2007/0113467 | A1 | 5/2007 | Abou-Nemeh | |
| 2007/0151143 | A1 | 7/2007 | Li et al. | |
| 2007/0179070 | A1 | 8/2007 | Kurihara et al. | |
| 2007/0248740 | A1 | 10/2007 | Sutkowski | |
| 2007/0289203 | A1 | 12/2007 | Deblase et al. | |
| 2008/0127550 | A1 | 6/2008 | Li et al. | |
| 2008/0163542 | A1 | 7/2008 | Krupa et al. | |
| 2008/0182768 | A1 | 7/2008 | Devlin et al. | |
| 2009/0221459 | A1 | 9/2009 | Habeeb et al. | |
| 2009/0221460 | A1 | 9/2009 | Habeeb et al. | |

FOREIGN PATENT DOCUMENTS

| | | | |
|---|---|---|---|
| WO | 2008120599 | A1 | 10/2008 |
| WO | 2008121526 | A1 | 10/2008 |
| WO | 2008124390 | A2 | 10/2008 |

OTHER PUBLICATIONS

N. Kapilan, et al., "Technical Aspects of Biodiesel and its Oxidation Stability", International Journal of ChemTech Research, vol. 1, No. 2, Apr.-Jun. 2009, pp. 278-282.

R. L. McCormick, et al., "Several factors affecting the stability of biodiesel in standard accelerated tests", Fuel Process Technology, 88, 2007, pp. 651-657.

Oliver Falk, et al., "The effect of fatty acid composition on biodiesel oxidative stability", Eur. J. Lipid Sci. Technol., 106, 2004, pp. 837-843.

"Higher tolerance . . . Lubricants must adapt for biodiesel onslaught", Infineum Insight, Issue No. 34, Jun. 2007.

Stephen Marsh, et al., "The effect of Biodiesel on Engine Lubricants", Lubes N' Greases, Jun. 2007, pp. 29-34.

A. Robben, et al., "Motor oil for biofuel", Mineraloeltechnik, 2007, 52, 4, pp. 1-16.

Howard L. Fang, "Quantification of Biodiesel Content in Fuels and Lubricants by FTIR and NMR Spectroscopy", SAE 2006-01-3301, Poertrain & Fluid Systems Conference & Exhibition, Toronto, Canada, Oct. 16-19, 2006.

K. Proc, et al., "100,000-Mile Evaluation of Transit Buses Operated on Biodiesel Blends (B20)", SAE 2006-01-3253, Powertrain and Fluid Systems Conference and Exhibition, Oct. 2006, Toronto, Canada.

M. A. Kalam, et al., "Effect of Palm Oil Methyl Ester and its Emulsions on Lubricant Degradation and Engine Component Wear", Lubrication Science 16-1, Nov. 2003.

A. K. Agarwal, "Experimental investigations of the effect of biodiesel utilization on lubricating oil tribology in diesel engines", Proceedings of the I MEC E part D Journal of Automobile Engineering, No. D5, May 2005, pp. 703-713.

A. K. Agarwal, et al., "Effect of Biodiesel Utilization of Wear of Vital Parts in Compression Ignition Engine", Journal of Engineering for Gas Turbines and Power, vol. 125, No. 2, pp. 604-611, Apr. 2003.

"Rapeseed oil with a double life—From engine oil to motor fuel", Erdol Erdgas Kohle, 117, 3, 2001, p. 149. Abstract Only.

L. G. Schumacher, et al., "Engine Oil Analysis of Diesel Engines Fueled with Biodiesel Blends", Presentation at the 2001 Annual International Meeting sponsored by ASAE, Sacramento, CA, Jul. 29-Aug. 1, 2001.

S. Vukas et al., "Influence of 'Bio-Diesel' Fuel on Diesel Engine Parts and Motor Oil", Journal of the Balkan Tribological Association, vol. 4, No. 4, 1998, 253-261.

L. E. Wagner, et al., "Effects of Soybean Oil Esters on the Performance, Lubricating Oil and Water of Diesel Engines", SAE Fuels Lubr. Meeting, Baltimore Oct. 8-11, 1984, Pap. N. 841385. Abstract Only.

S. Romano, "Vegetable Oils . . . A New Alternative [to Diesel Fuel]", Am. Soc. Agric. Eng. Int., Plant Vegetable Oils Fuels' Conference, Fargo, North Dakota, Aug. 2-4, 1982, pp. 106-116. Abstract Only.

"Biodiesel can halve drain intervals", OATS Bulletin, Issue 85, Sep. 2007. Abstract Only.

* cited by examiner

LUBRICATING OIL COMPOSITIONS FOR BIODIESEL FUELED ENGINES

This application claims benefit of U.S. Provisional Application 61/278,231 filed Oct. 2, 2009.

BACKGROUND OF THE INVENTION

1. Field of the Invention

The present invention relates to the lubricating oils used to lubricate engines run on biodiesel fuels and to the improvement in resistance to oxidation of such lubricating oils.

2. Description of the Related Art

Several types of biodiesel fuels have been proposed for as well as introduced into the diesel fuel blend pool for use in commercial and passenger vehicles. The biodiesel fuels would be used as the exclusive fuel or as an addition to hydrocarbon-based diesel fuels. When used as an addition to hydrocarbon-based diesel fuels, the biodiesel fuels constitute anywhere from 2 to 50 wt % of the resulting diesel fuel blends, preferably 5 to 30 wt % of the blend. In Europe biodiesel fuels either are being considered or already have been mandated for use in hydrocarbon-based diesel fuels in an amount in the range of 5 to 10 wt %.

Biodiesel fuels are being considered as alternatives to hydrocarbon-based diesel fuels or as diesel fuel blend pool components because of their derivation from renewable plant and animal oils.

Biodiesel fuels are mixtures of lower, short chain esters of mixed saturated and unsaturated straight chain fatty acids derived from vegetable and/or animal fats and oils. The straight chain fatty acids are, typically, $C_{10}$ to $C_{26}$ fatty acids, preferably $C_{12}$ to $C_{22}$ fatty acids. The fatty acids are made into biodiesel by trans-esterification using short chain alcohols; e.g., $C_1$ to $C_5$ alcohols, in the presence of a catalyst such as a strong base.

Vegetable and/or animal oils and fats are natural triglycerides and are renewable sources of starting material. Typical vegetable oils are soybean oil, rapeseed oil, corn oil, jojoba oil, safflower oil, sunflower seed oil, hemp oil, to coconut oil, cottonseed oil, sunflower oil, palm oil, canola oil, peanut oil, mustard seed oil, olive oil, spent cooking oil, etc., without limitation. Animal fats and oils include beef, pork, chicken fat, fish oil and oil recovered by the rendering of animal tissue.

Plant source biodiesel fuels are currently the more dominant type in the marketplace. The primary plant sources are soy in North America, rapeseed in Europe, and palm and the other plant source oils elsewhere.

The biodiesel is made by esterifying one or a mixture of such oils and fats using one or a mixture of short chain; e.g., $C_1$ to $C_5$, alcohols, preferably methanol.

Because the most economical trans-esterification processes are performed using methanol, the biodiesel products are identified with reference to the oil or fat source; e.g., soy methyl ester (SME), rapeseed methyl ester (RME), etc.

Trans-esterification is effected by the base catalyzed reaction of the fat and/or oil with the alcohol, direct acid catalyzed esterification of the oil and/or fat with the alcohol, or conversion of the oil and/or fat to fatty acids and then to alkyl esters with alcohol in the presence of an acid catalyst. In base catalyzed trans-esterification, the oil and/or fat is reacted with a short chain alcohol, preferably methanol, in the presence of a catalyst such as sodium hydroxide or potassium hydroxide to produce glycerin and short chain alkyl esters. The glycerin is separated from the product mixture and biodiesel is recovered. Any unreacted alcohol is removed by distillation. The recovered biodiesel is washed to remove residual catalyst or soap and dried.

Because of the natural sources of the oils and/or fats upon which the biodiesel fuels are based, the biodiesel molecules are mixtures of various to molecular weights with ester functionality and up to two olefinic double bonds.

The presence of the olefinic double bonds and ester functionality in the biodiesel fuels results in the biodiesel fuels being susceptible to oxidative degradation, resulting in the unsuitability of biodiesel for long term storage.

Further, the instability of ester and olefinic double bonds in the biodiesel fuels also is a source of oxidative instability of the lubricating oil used to lubricate biodiesel fueled engines, the lubricating oil being rendered more susceptible to sludge and deposit formation.

The improvement in the oxidation stability of biodiesel fuel has been the subject of investigation leading to the addition to such fuel of various additives and combinations of additives to effect the desired stabilization.

WO 2008/056203 teaches stabilizer compositions for blends of petroleum and renewable fuels. Mixtures of renewable fuels such as biodiesel, ethanol and biomass mixed with conventional petroleum fuel are stabilized by the addition thereto of a multifunctional additive package which is a combination of one or more additives selected from the group consisting of a free radical chain terminating agent, a peroxide decomposition agent, an acid scavenger, a photochemical stabilizer, a gum dispersant and a metal sequestering agent. Peroxide decomposition agents are selected from the group containing sulfur, nitrogen and phosphorus compounds. Suitable nitrogen-containing compounds are of the general formula:

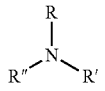

wherein R, R' and R" can be alkyl linear, branched, saturated or unsaturated $C_1$-$C_{30}$, aromatic, cyclic, poly alkoxy, polycyclic. Identified as a useful nitrogen-containing compound is N—N_dimethylcyclohexylamine. While N,N-dimethylcyclohexylamine is taught as a useful peroxide decomposition agent, in the examples it is never employed by itself but always in combination with a phenolic anti-oxidant. Reference to FIG. 2 of WO 2008/056203 reveals that whereas the use of the combination of 75% phenol and 25% N,N-dimethylcyclohexylamine (at a treat level of 200 mg/l) resulted in an improvement in the relative stability of the fuel as compared to using 100% phenol over all time periods tested, an increase in the amount of N,N-dimethylcyclohexylamine in the additive mixture to 50% significantly reduced the beneficial effect of the additive mixture (still at a treat level of 200 mg/l) in terms of relative stability over all time periods tested as compared to the 75% phenol/25% N,N-dimethylcyclohexylamine mixture with the most significant reduction in benefit being observed over the long term; i.e., at the six hour time period.

U.S. 2004/0152930 teaches stable blended diesel fuel comprising an olefinic diesel fuel blending stock containing olefins in an amount of 2 to 80 wt %, non-olefins in an amount of 20 to 98 wt % wherein the non-olefins are substantially comprised of paraffins, oxygenates in an amount of at least 0.012 wt % and sulfur in an amount of less than 1 ppm, the blend diesel being stabilized by an effective amount of a sulfur-free anti-oxidant. An effective amount of sulfur-free anti-oxidant is identified as 5 to 500 ppm, preferably 8 to 200 ppm of additive.

The sulfur-free anti-oxidant is selected from the group consisting of phenols, cyclic amines and combinations thereof. Preferably the phenols contain one hydroxyl group and are hindered phenols. The cyclic amine anti-oxidants are amines of the formula:

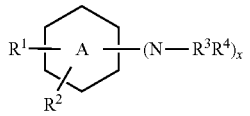

wherein A is a six-membered cycloalkyl or aryl ring, $R^1$, $R^2$, $R^3$ and $R^4$ are independently H or alkyl and X is 1 or 2. An example of the sulfur-free anti-oxidant is given as di-methyl-cyclohexylamine. See also U.S. Pat. No. 7,179,311.

"Evaluation of the Stability, Lubricity and Cold Flow Properties of Biodiesel Fuel", J. Andrew Waynick, $6^{th}$ International Conference on Stability and Handling of Liquid Fuel", Vancouver, B.C., Canada, Oct. 13-17, 1997, pages 805-829 addresses various aspects of biodiesel fuel and reports an example where a blend of 80% low sulfur No. 2 diesel fuel/20% methyl soyate ester biodiesel fuel was combined with 20 ppm N,N-dimethylcyclohexylamine. At page 813 the report states that "although additive C (the N,N-dimethylcyclohexylamine) did not control hydroperoxide or insolubles formulations, it did hold the TAN to a level near that of the fuel blend with anti-oxidant additive A (N,N-di-sec-butyl-p-phenylenediamine) and B (2,6-di-t-butyl-4-methyl phenol)".

U.S. 2008/0127550 discloses stabilized biodiesel fuel composition wherein the stabilizing agent is a combination of: i) one or more compounds selected from the group consisting of sterically-hindered phenolic anti-oxidants; and ii) one or more compounds selected from the group consisting of triazole metal deactivators.

U.S. 2007/0151143 discloses a stabilized biodiesel wherein the stabilizing additive is selected from one or more of the group consisting of the 3-arylbenzofuranones and the hindered amine light stabilizers and, optionally, one or more hindered phenolic anti-oxidants.

U.S. 2007/0248740 discloses an additive composition comprising 2,5-di-tert-butyl hydroquinone (BHQ), N,N'-disalicylidenepropylenediamine. The additive is used to stabilize fuel containing at least 2% by weight of an oil derived from plant or animal material.

U.S. Pat. No. 3,336,124 discloses stabilized distillate fuel oils and additive compositions for such fuel oils. One additive composition comprises a mixture of: (a) an oil soluble dispersant terpolymer of a particular type; (b) from 0.2 to about 3 parts by weight per part of said oil soluble dispersant tripolymer of N,N-dimethylcyclohexylamine; and (c) a normally liquid inert hydrocarbon carrier solvent in an amount to constitute from about 20% to 80% by weight of the additive composition. See also GB 1,036,384.

WO 2008/124390 discloses a synergistic combination of a hindered phenolic anti-oxidant and a detergent to improve the oxidation stability of biodiesel fuel.

While this reference purports to teach a synergistic mixture of a detergent and a hindered phenol anti-oxidant, the detergent is not any of the metal salt type such as alkali or alkane earth metal sulfonates, phenates, carboxylate or salicylate, but, rather, nitrogen-containing detergents such as hydrocarbyl substituted arylated nitrogen compounds (e.g., polyisobutylene succinic anhydride polyamine, i.e., PIBSA-PAM), hydrocarbyl substituted amines (e.g., polyisobutylene amine), and Mannich base-type detergents which are the reaction products of a hydrocarbyl-substituted phenol, an amine and formaldehyde.

U.S. 2007/0289203 is directed to a synergistic combination of anti-oxidants for biodiesel fuels. The synergistic combination is a mixture of a certain aminic anti-oxidant in combination with a phenolic anti-oxidant. While the optional presence of additional components such as detergents is recited at para. [0038], no specific teaching appears to have been made regarding salicylate or phenates nor to any premixing of the components.

WO 2008/121526 is directed to anti-oxidant blends in biodiesel. The anti-oxidant blend is a combination of (1) mono- or bis-hindered phenols derived from 2,6-di-tert butylphenol, and (2) N,N'-disubstituted paraphenylene diamine.

U.S. 2007/0113467 is directed to biodiesel fuel of improved oxidation stability comprising biodiesel fuel and at least one anti-oxidant, the anti-oxidant being selected from the specific group recited at paras. [0006] to [0012]. The possible presence of other additives in the biodiesel is mentioned at para. [0052], such other additives including but not being limited to cetane improvers, ignition accelerator agents, metal deactivators, cold flow improvers, etc. Detergents are recited at para. [0065], but are of the PIBSA-PAM and Mannich base variety. No mention is made of alkali or alkaline earth metal salicylates or phenates nor of the desirability that these detergents be of higher TBN or used as premixes with phenolic and/or aminic anti-oxidants.

U.S. 2008/0182768 is directed to a lubricant composition for biodiesel fuel engine applications. The lubricant contains a major amount of a lubricating oil and a minor amount of a highly grafted multifunctional olefin copolymer, the multifunctionality being derived from the presence of amine moiety on the copolymer (para. [0058] to [0071]). The presence of a DI package is mentioned at para. [0085], the detergent including a metal-containing ash-forming detergent, preferably overbased (TBN 150 or greater) which can be sulfonate, phenate, sulfurized phenate, thiophosphonate, salicylate, naphthenate or other is oil-soluble carboxylates of alkali or alkaline earth metal. See para. [0086].

"Examples" are mentioned at para. [0123] but there appears to be no mention of any detergents at all being used in the Examples.

U.S. 2008/0127550 stabilizes biodiesel fuel by adding to it an effective amount of a combination of one or more stearically hindered phenols and one or more triazole metal deactivators. No mention appears to be made regarding detergents, but materials such as copper naphthenate, copper acetate, iron naphthenate are disclosed in the Examples.

No mention appears to be made regarding alkali or alkaline earth metal salicylates, phenates, carboxylates and/or sulfonates, nor of the TBN of such detergents nor of their use in combination with phenolic and/or aminic anti-oxidants, or as premixes.

DESCRIPTION OF THE INVENTION

Figure 1:
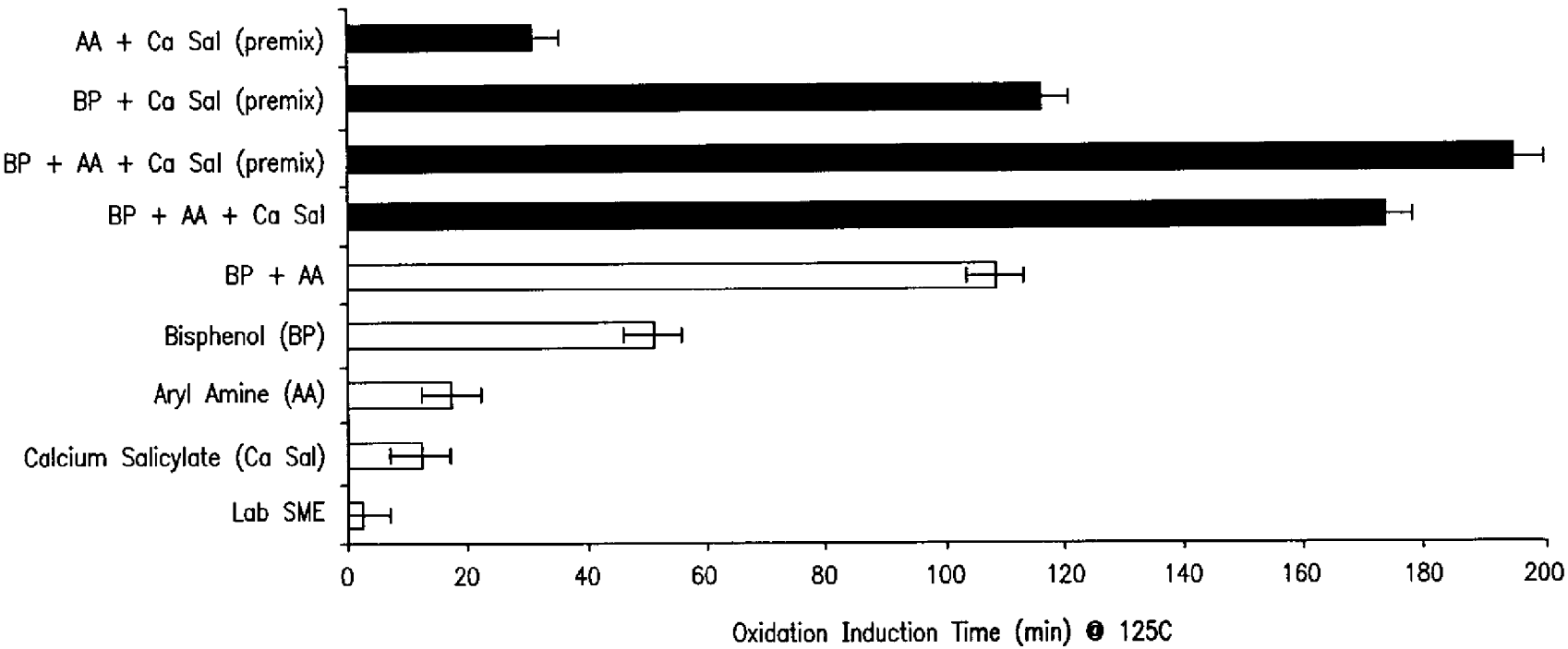
FIG. 1 compares the effect of various detergents and anti-oxidants used individually, as combinations and as combination premixes in the oxidation induction time of lab soy methyl ester biodiesel fuel.

The present invention is directed to a method for improving the resistance to oxidation of lubricating oils used for the lubrication of engines run on fuels comprising biodiesel fuels or mixtures of biodiesel fuels and hydrocarbon diesel fuels. It is also directed to a method for improving the oxidation resistance of biodiesel fuels or mixtures of biodiesel fuels and hydrocarbon diesel fuels.

The oxidation resistance of lubricating oils used to lubricate engines run on biodiesel fuels or mixtures of biodiesel fuels and hydrocarbon diesel fuels is improved by the addition to the lubricating oil or to the biodiesel fuel of a combination of one or more detergents selected from one or more alkali and/or alkaline earth metal and/or hydrocarbyl salicylate and/or phenate and one or more hindered phenolic anti-oxidants and/or hindered aminic anti-oxidants and/or organo metallic anti-oxidants.

The oxidation resistance of the biodiesel fuel or mixture of biodiesel fuel and hydrocarbon diesel fuel is improved by the addition to the fuel of a combination of one or more detergents selected from one or more alkali and/or alkaline earth metal and/or hydrocarbyl salicylate and/or phenate and one or more hindered phenolic anti-oxidants and/or hindered aminic anti-oxidants and/or organo metallic anti-oxidants. As used herein, the term "hydrocarbon diesel fuel" is meant to indicate a fuel which is other than the biodiesel fuel. Such hydrocarbon diesel fuels include, without limitation, diesel fuels derived from mineral oil, petroleum crude oil and diesel fuel made via the gas-to-liquid process employing synthesis gas (CO and $H_2$), for example, the Fischer-Tropsch process.

The detergents used in the present invention are selected from one or more alkali metal salicylate or phenate, one or more alkaline earth metal salicylate or phenate, one or more hydrocarbyl salicylate or phenate and mixtures of such detergents.

The alkali metal is preferably sodium or potassium, most preferably sodium, the alkaline earth metal is preferably magnesium or calcium, preferably calcium and the hydrocarbyl substituent is preferably selected from $C_1$-$C_{20}$ alkyl, $C_4$-$C_{20}$ branched alkyl, $C_6$-$C_{20}$ aryl, $C_7$-$C_{20}$ aryl alkyl, $C_7$-$C_{20}$ alkyl aryl, which may be heteroatom, i.e. sulfur, nitrogen or oxygen, substituted, preferably nitrogen substituted, in either the carbon skeleton or by heteroatom-containing substituent groups, preferably the hydrocarbyl-substituted is a $C_1$-$C_{20}$ alkyl amine, still more preferably a $C_6$-$C_{12}$ alkyl amine. An example of a useful hydrocarbyl substituent is PRIMENE 81R®, which is a $C_{12}$ primary amine wherein the nitrogen is attached to a tertiary carbon atom.

When alkali metal or alkaline earth metal salicylates and/or phenates are used they may be neutral or overbased, i.e. they may have a TBN ranging from 1 to about 500, preferably 10 to 400, more preferably 50 to 100, most preferably 250 to 400. TBN is reported as mg KOH/g.

The alkali metal and/or alkaline earth metal and/or hydrocarbyl salicylate or phenate detergent and the hindered phenolic and/or aminic anti-oxidant are used in a weight ratio (active ingredient) of total salicylate and/or phenate detergent to total anti-oxidant in the range 1:99 to 99:1, preferably 40:60 to 60:40, most preferably 50:50.

In a preferred embodiment the detergent and the anti-oxidant are employed as a premix rather than as individually added components to the lubricating oil.

Most preferably the detergent is hydrocarbyl-substituted salicylate (salicylate bearing a substituent which is a $C_{12}$ primary amine wherein the nitrogen is attached to a tertiary carbon atom) or magnesium salicylate and the anti-oxidant is a mixture of aminic and phenolic anti-oxidant, the components being employed as a premix.

When both a phenolic anti-oxidant and an aminic anti-oxidant are present, they may be present in a weight ratio (active ingredient) in the range 1:99 to 99:1, preferably 40:60 to 60:40, most preferably 50:50.

When the detergent is a metal overbased detergent, it is preferred that the TBN of the detergent be above 50, more preferably above 300.

In addition to the necessarily present alkali metal and/or alkaline earth metal and/or hydrocarbyl salicylate and/or phenate, other detergents may also be present. Those additional, other detergents include alkali metal and/or alkaline earth metal and/or hydrocarbyl sulfonates and/or stearates.

The anti-oxidant is selected from phenols, aromatic amines, organometallic compounds, oil soluble organometallic coordination complexes and mixtures thereof.

The phenols include sulfurized and non-sulfurized phenolic anti-oxidants. The terms "phenolic type" or "phenolic anti-oxidant" used herein includes compounds having one or more than one hydroxyl group bound to an aromatic ring which may itself be mononuclear; e.g., benzyl, or polynuclear; e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bis-phenol type compounds including such bi-phenol compounds linked by alkylene bridges, sulfur bridges or oxygen bridges. Alkyl phenols include mono- and poly-alkyl or alkenyl phenols, the alkyl or alkenyl group containing from about 3-100 carbons, preferably 4-50 carbons and sulfurized derivatives thereof, the number of alkyl or alkenyl groups present on the aromatic ring ranging from 1 to up to the available unsatisfied valences of the aromatic ring remaining after counting the number of hydroxyl groups bound to the aromatic ring.

Generally, therefore, the phenolic antioxidant may be represented by the general formula:

$$(R^4)_x—Ar—(OH)y$$

where Ar is selected from the group consisting of:

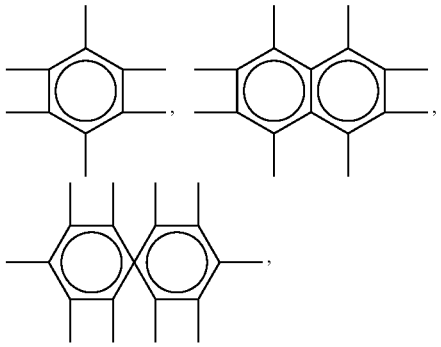

-continued

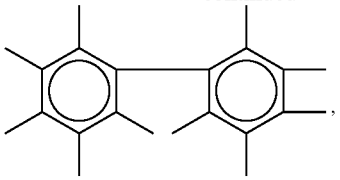

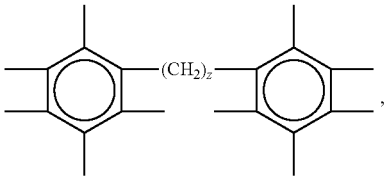

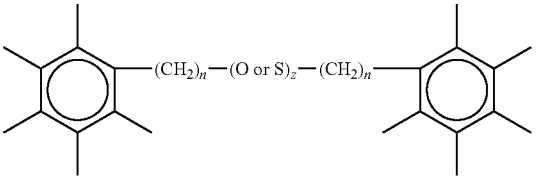

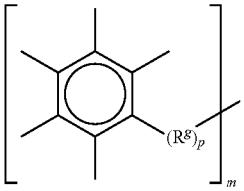

wherein $R^A$ is hydrogen or a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_{20}$ alkylene or sulfur substituted alkylene group, y is at least 1 to up to the available valences of Ar, x to ranges from 0 to up to the available valences of Ar-y, z ranges from 1 to 10, n ranges from 0 to 20, and m is 1 to 5 and p is 1 or 2, preferably y ranges from 1 to 3, x ranges from 0 to 3, z ranges from 1 to 4 and n ranges from 0 to 5, and p is 1.

Preferred phenolic anti-oxidant compounds are hindered phenolics which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_1$+ alkyl groups and the alkylene sulfur bridge or oxygen bridge coupled derivatives of these hindered phenols. Examples of phenolic materials of this type include 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4-methyl phenol; 2,6-di-t-butyl-4-ethyl phenol; and 2,6-di-t-butyl-4 alkoxy phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho coupled bis-phenols include: 2,2'-bis(6-t-butyl-4-heptyl phenol); 2-2'-bis(6-t-butyl-4-octyl phenol); and 2,2'-bis(6-t-butyl-4-dodecyl phenol). Para coupled bis-phenols include, for example, 4,4'-bis(2,6-di-t-butyl phenol) and 4,4'-methylene-bis(2,6-di-t-butyl phenol).

Phenolic type antioxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic antioxidants which can be used in the present invention.

Aromatic aminic compound antioxidants include alkylated or non-alkylated aromatic amines such as aromatic monoamine of the formula:

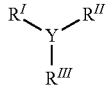

where $R^I$ is an aliphatic, aromatic or substituted aromatic group, $R^{II}$ is an aromatic or a substituted aromatic group and $R^{III}$ is hydrogen, alkyl, aryl or $R^{IV}S(O)nR^V$, wherein $R^{IV}$ is alkylene, alkenylene or arylalkylene group and $R^V$ is a higher alkyl group, or an alkenyl, aryl or alkaryl group and n is 0, 1 or 2. When $R^I$ is an aliphatic group it may contain from 1 to about 20 carbon atoms, and preferably contains from about 6 to 12 carbon atoms. The aliphatic group is a saturated aliphatic group. Preferably both $R^I$ and $R^{II}$ are aromatic or substituted aromatic group and the aromatic group may be a single ring or fused multi-ring aromatic group such as naphthyl aromatic group. $R^I$ and $R^{II}$ may be joined together with other groups such as sulfur. $R^{III}$ is preferably hydrogen.

Typical aromatic amine antioxidants are diphenyl amine and phenyl naphthylamine, wherein the phenol and/or naphthyl group(s) has (have) alkyl substituted group(s) of at least about 6 carbon atoms.

Examples of aliphatic groups include hexyl, heptyl, octyl, nonyl, and decyl. Generally the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Oil soluble organometallic compounds and/or oil soluble organometallic coordination complexes suitable for use as the anti-oxidant in the present invention are materials selected from the group consisting of:

(a) one or more metal(s) or metal cation(s) having more than one oxidation state above the ground state, excluding iron and nickel, complexed, bonded or associated with two or more anions;

(b) one or more metal(s) or metal cation(s) having more than one oxidation state above the ground state, excluding iron and nickel, complexed, bonded or associated with one or more bidentate or tridentate ligands;

(c) one or more metal(s) or metal cation(s) having more than one oxidation state above the ground state, excluding iron and nickel, complexed, bonded or associated with one or more anions and one or more ligands; and (d) mixtures thereof.

provided the anion and/or ligand does not itself render the metal cation inactive; i.e., renders the metal cation unable to change from one oxidation state above the ground state to another oxidation state above the ground state, decompose or cause polymerization of the metal salt, thereby rendering the metal cation inactive as a peroxide decomposer, and further provided that when the metal or metal cation is molybdenum, the ligand is not thiocarbamate, thiophosphate, dithiocarbamate or dithiophosphate.

Examples of suitable metal-containing anti-oxidants include copper dihydrocarbyl thio- or dithio-phosphates, copper polyisobutylene succinic anhydride and copper salts of carboxylic acid (naturally occurring or synthetic). Other suitable copper salts include copper dithiocarbamates, sulphonates, phenates, and acetylacetonates. Basic, neutral or acidic copper Cu(I) and/or Cu(II) salts derived from alkenyl succinic acids and anhydrides are known to be useful anti-oxidants.

The additive is added to the biodiesel fuel, mixtures of biodiesel fuel and hydrocarbon diesel fuel or any lubricating oil which comprises an oil of lubricating viscosity and is selected from one or more natural oil base stocks and/or base oils and synthetic base stocks and/or base oils which may additionally contain at least one other performance additive.

A wide range of lubricating base oils is known in the art. Lubricating base oils are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration and percolation. Rerefined oils are obtained by processes analogous to refined oils but using an oil that has been previously used.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stocks generally have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source; for example, as to whether they are paraffinic, naphthenic, or mixed paraffinic-naphthenic. Oils derived from coal or shale are also useful. Natural oils vary also as to the method used for their production and purification; for example, their distillation range and whether they are straight run or cracked, hydrorefined, or solvent extracted.

Group II and/or Group III hydroprocessed or hydrocracked base stocks, including synthetic oils such as polyalphaolefins, alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are incorporated herein by reference in their entirety.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatics can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{40}$ often being preferred. A mixture of hydrocarbyl groups is often preferred. The hydrocarbyl group can optionally contain sulfur, oxygen, and/or nitrogen-containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primary comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Esters comprise a useful base stock or base stock blend component. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols; e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acids, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially; for example, the MOBIL P-41® and P-51® esters of ExxonMobil Chemical Company.

Non-conventional or unconventional base stocks and/or base oils include one or a mixture of base stock(s) and/or base oil(s) derived from: (1) one or more Gas-to-Liquids (GTL) materials, as well as; (2) hydrodewaxed, or hydroisomerized/cat (and/or solvent) dewaxed base stock(s) and/or base oils derived from synthetic wax, natural wax or waxy feeds, mineral and/or non-mineral oil waxy feed stocks such as gas oils, slack waxes (derived from the solvent dewaxing of natural oils, mineral oils or synthetic; e.g., Fischer-Tropsch feed stocks), natural waxes, and waxy stocks such as gas oils, waxy fuels hydrocracker bottoms, waxy raffinate, hydrocrackate, thermal crackates, foots oil or other mineral, mineral oil, or even non-petroleum oil derived waxy materials such as waxy materials received from coal liquefaction or shale oil, linear or branched hydrocarbyl compounds with carbon number of about 20 or greater, preferably about 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, to generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

As previously indicated, the oxidation resistance of the biodiesel fuel, the mixture of biodiesel fuel and hydrocarbon diesel fuel or the lubricating oils used to lubricate engines run on biodiesel fuel or mixtures of biodiesel fuel and hydrocarbon diesel fuel is improved by use of a combination of alkali and/or alkaline earth and/or hydrocarbyl salicylate and/or phenate and phenates and/or aminic anti-oxidants, preferably as a premix.

When added to the lubricating oil the additive combination, preferably as a premix, can be added in an amount in the range of 0.5 to 20 wt %, preferably 3 to 15 wt %, most preferably 10 to 15 wt %, based on the total weight of the formulated lubricating oil composition.

When added to the biodiesel fuel the additive combination, preferably as a premix, can be added in an amount in the range of 0.1 to 7 wt %, preferably 0.2 to 2 wt %, based on the total weight of the biodiesel fuel plus additive.

The additive combination can be added directly to the lubricating oil or it can be added to the biodiesel fuel. Preferably it is added to the lubricating oil, most preferably as a premix. The present invention is also directed to the premix per se which can be added as an aftermarket additive booster to the lubricating oil by the consumer.

The premix can be made employing any order of addition of the components. The components are mixed neat, neat meaning that the components are mixed in the absence of the lubricating oil or biodiesel fuel into which they are eventually intended to be added. Two different premixing procedures can be used. It is not critical which procedure is used. Both procedures provide the desired "premix composition".

Step-wise Addition and Heating/Mixing Procedure:

A first component, such as the anti-oxidant, can be weighed and added to a vessel and heated with stirring to a temperature in the range of 20° C. to 180° C., preferably 40° C. to 160° C., more preferably 60° C. to 90° C. and held at that temperature for from 30 to 500 minutes, preferably 30 to 200 minutes, more preferably 30 to 180 minutes. To this heated material can then be added a second component, e.g. the detergent or the organic base, with the resulting mixture being heated to a temperature in the aforesaid ranges and held at the temperature for a time in the aforesaid ranges. The final component is then added to the mixture, again with heating to a temperature in the aforesaid range with holding at that temperature for a time in the aforesaid range. Alternatively, two components can be added initially with heating to within the aforesaid range for a time in the aforesaid range, after which the third component is added with heating in the aforesaid range for a time in the aforesaid range.

All-in-one Addition and Heating/Mixing Procedure:

All three components are added to the vessel in any required sequence, preferably detergent, anti-oxidant, organic base, then the mixture is heated, with stirring, to a temperature in the aforesaid range and the mixture is held at the temperature, with mixing, for a time in the aforesaid range.

Following the premixing, the mixture is added in the desired amount to the lubricant, the biodiesel or both, preferably to the lubricant.

This premixing is conducted in the absence of any of the lubricating oil or the biodiesel fuel into which the additives are to be added. That is, the additives are combined either in their as-received form or as 100% active ingredient materials. Such additives are defined in this specification as being in the "neat form". Additives in the as-received form can be either 100% active ingredient or supplied by the manufacturer in a carrier fluid but are still considered "neat" for the purposes of this specification.

The mixture of neat additives when subject to the process of heating with stirring at a temperature in the aforesaid recited range for a time in the aforesaid recited range produces a product (a premix) that is believed to be an anti-oxidant/detergent complex. The complex is characterized by the existence of chemical or physical bonds or combinations of chemical and physical bonds between the components.

Such a complex is not produced when the components are simply added individually to a lubricating oil or biodiesel fuel and heated because of the solvent effect of the lubricating oil or biodiesel fuel which interferes with the formation of such chemical and/or physical bonds or linkages between the components.

EXAMPLES

In the following Examples, all of the additives employed were 100% active ingredient.

Example 1

Biodiesel model compounds were evaluated for oxidative stability and deposit formation in the presence of metal containing detergents, ashless detergents and anti-oxidants. Test procedure is as follows: 0.5 g of biodiesel was placed in a 50 cc sealed tube and heated to 205° C. for 30 minutes with shaking. After cooling to room temperature the samples were evaluated by capillary gas chromatography.

Results for Ca Salicylate:

TABLE 1

| | Oxidation Extent, % | Epoxy-stearates, % | Dimeric Products, % |
|---|---|---|---|
| Methyl Oleate (MeOl) | 5.61 | 1.49 | 1.4 |
| MeOl + 0.5 wt % (hindered phenol) | 3.97 | 1.14 | 1.32 |
| MeOl + 0.5 wt % (hindered amine) | 3.81 | 1.02 | 1.07 |
| MeOl + 0.5 wt % Ca Sal (TBN = 64) | 4.8 | 1.32 | 1.2 |
| MeOl + 0.3 wt % Ca Sal + 0.1 wt % hindered amine + 0.1 wt % hindered phenol | 3.07 | 0.81 | 0.97 |
| MeOl + Premixed 0.3 wt % Ca Sal (ID: 3381) + 0.1 wt % hindered amine + 0.1 wt % hindered phenol (TBN = 64) | 2.33 | 0.62 | 0.81 |

The premix was made by heating the detergent to 60° C. for 30 minutes with stirring, then adding the hindered phenol anti-oxidant to the detergent and heating at 60° C. for an additional 30 minutes with stirring and finally adding the hindered amine anti-oxidant to the mixture and heating at 60° C. for an additional 30 minutes with stirring.

Results for PRIMENE 81R®: 5-Octyldodecyl Salicylate:

TABLE 2

| | Oxidation Extent, % | Epoxy-stearates, % | Dimeric Products, % |
|---|---|---|---|
| MeOl | 5.61 | 1.49 | 1.4 |
| MeOl + 0.5 wt % (hindered phenol) | 3.97 | 1.14 | 1.32 |
| MeOl + 0.5 wt % (hindered amine) | 3.81 | 1.02 | 1.07 |
| MeOl + 0.5 wt % Primene 81R:5-Octyl Salicylate | 4.3 | 1.27 | 1.11 |
| MeOl + 0.3 wt % Primene 81R:5-Octyl Salicylate + 0.1 wt % hindered amine + 0.1 wt % hindered phenol | 3.07 | 0.81 | 0.97 |
| MeOl + Premixed 0.3 wt % Primene 81R:5-Octyl Salicylate + 0.1 wt % hindered amine + 0.1 wt % hindered phenol | 2.11 | 0.67 | 0.69 |

The premix was made using the same procedure as previously outlined but substituting the Primene 81R:5-octyl salicylate for the calcium salicylate.

These results show that both metal-containing and ashless detergents show significant synergistic interaction with the anti-oxidants to enhance the oxidative stability of biodiesel fuel, with the preferred premix of detergent and anti-oxidant showing the most benefit to the stability and control of the deposit content of the biodiesel fuel.

Example 2

Pressure Differential Scanning

Calorimetry (PDSC Experiments)

Biodiesel model compounds were evaluated for oxidative stability in the presence of metal detergents and anti-oxidants. Test procedure is as follows: A Laboratory sample of Soy Methyl Ester (LSME) was made with 66% C18.2 FAME and 34% C 18,1 FAME. To this was added either individually or where indicated as a premix calcium salicylate overbased detergent (TBN 64), aryl amine (AA) and hindered bis-phenol (BP) in an amount such that the additized LSME contained 3.5 wt % detergent, 0.75 wt % aryl amine and 0.75 wt % hindered bis-phenol, regardless of whether each component was added individually or as premix of the component. In a PDSC pan about 6 mg of the additized LSME was placed and temperature maintained at 125° C. An oxidation induction time experiment was conducted and the time taken for the oxidation to be induced determined. The result is expressed as oxidation induction time (OIT). The error in OIT measurements is 5 minutes.

In the first set of experiments (FIG. 1) the synergism between the detergent and anti-oxidants is demonstrated. The OIT of the detergent+aryl amine+bis-phenol is higher than each of the individual components.

The PDSC test is the CEC L-85-T-90 test developed in Europe for ACEA E5 specification for heavy duty diesel oils. This test differentiates between base oils and additives and is used to identify interaction between anti-oxidants. The results have been found to correlate with other oxidation tests.

Figure 2:
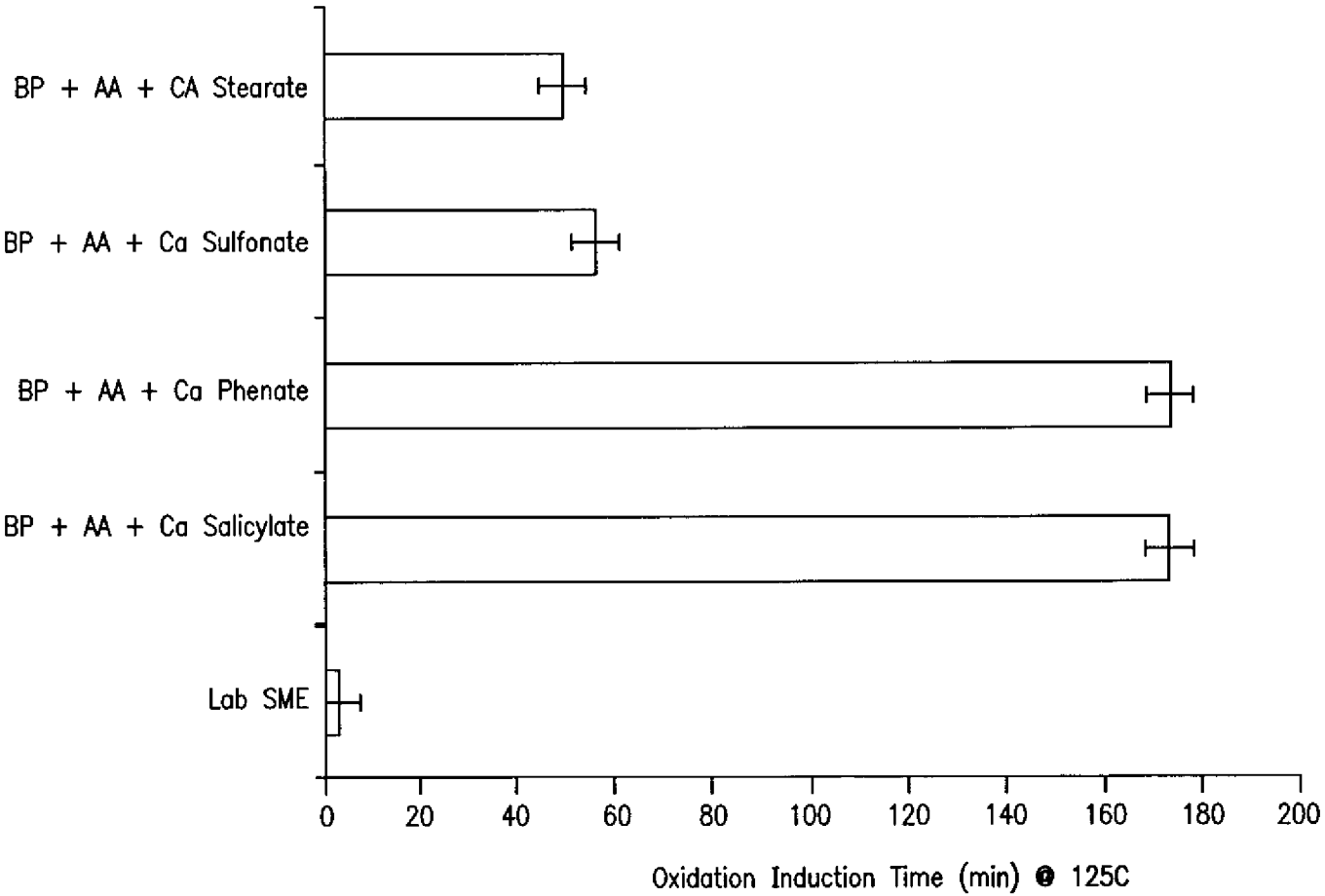
FIG. 2 compares the effect of combination of biophenol, aryl amine and calcium salicylate or calcium phenate or calcium sulfonate or calcium stearate on the oxidation induction time of lab soy methyl ester biodiesel fuel.

In the second set of experiments (FIG. 2 and Table 3), the effect of the surfactant component of the metal (calcium) detergent on the synergism of the mixture bis-phenol, aryl amine and calcium detergent is demonstrated. It is seen that even without premixing the combination of 0.75 wt % bis-phenol, 0.75 wt % aryl amine and 3.5 wt % calcium salicylate (TBN 64) or 3.5 wt % calcium phenate (TBN 64) produced superior results compared to combinations of bis-phenol, aryl amine and calcium sulfonate or calcium stearate.

TABLE 3

| Sample | Induction Time (minutes) |
|---|---|
| Lab Soy Methyl Ester (LSME) | 2.5 ± 5 |
| LSME + BP + AA + Ca Stearate | 45 ± 5 |
| LSME + BP + AA + Ca Sulfonate | 55 ± 5 |
| LSME + BP + AA + Ca Phenate | 175 ± 5 |
| LSME + BP + AA + Ca Salicylate | 175 ± 5 |

Figure 3:
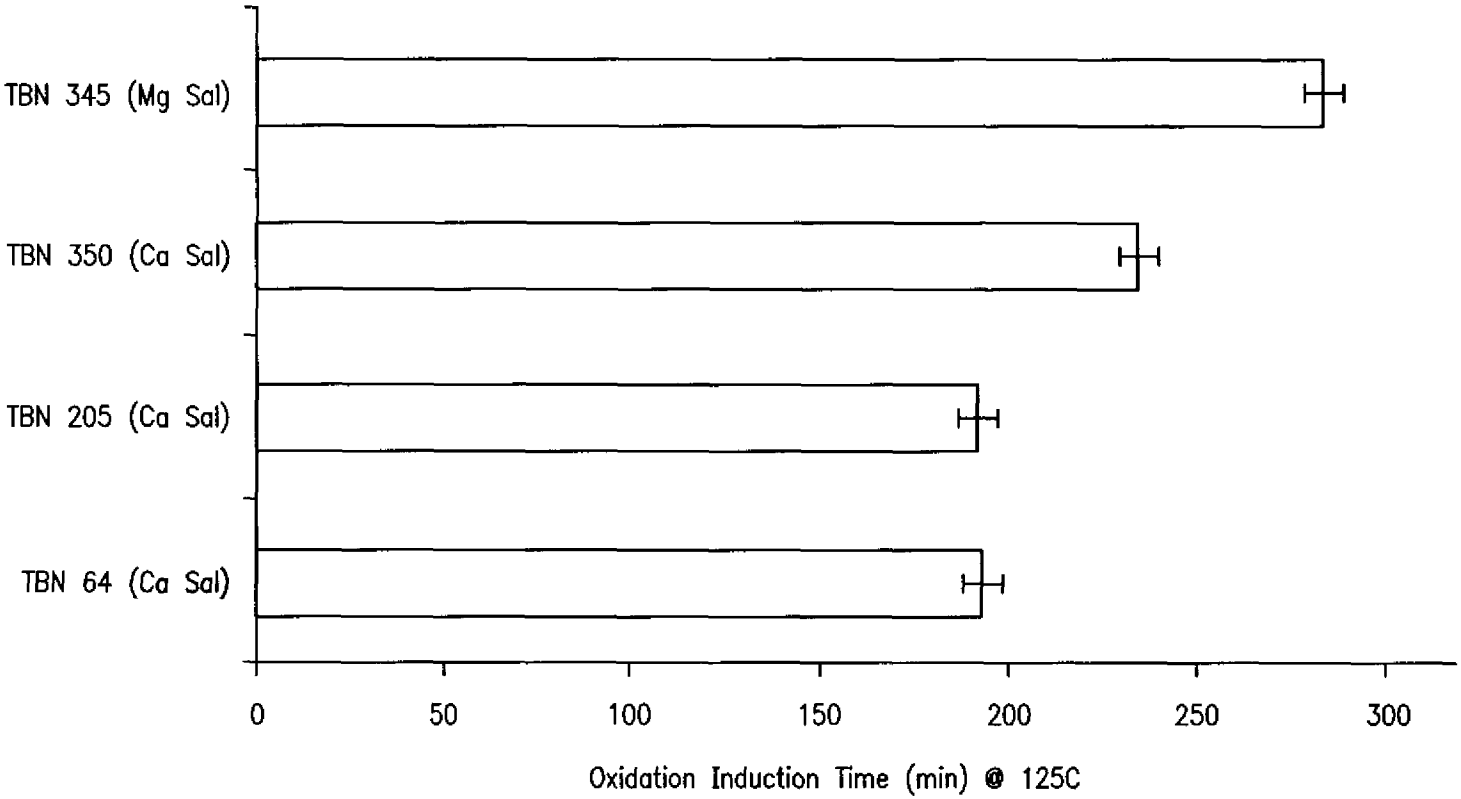
FIG. 3 shows the effect TBN and metal type has on the oxidation induction time of lab soy methyl ester biodiesel comparing premixes of bis-phenol, fatty acid methyl ester (FAME), aryl amine and calcium salicylate and magnesium salicylate of different TBN.

In the third set of experiments (FIG. 3 and Table 4), the influence of total base number (TBN) of the metal overbased detergent on the synergism of the detergent anti-oxidant combination is investigated. It was found that synergism is increased at detergent TBN above 250. For the same TBN the magnesium salicylate detergent provided a stronger effect than the calcium salicylate detergent. In the set of experiments the detergent/anti-oxidant combination was used as a premix.

TABLE 4

| Component | Induction Time (minutes) |
|---|---|
| LSME + Premix (BP, AA, Ca Salicylate, TBN64) | 192 ± 5 |
| LSME + Premix (BP, AA, Ca Salicylate, TBN 205) | 192 ± 5 |
| LSME + Premix (BP, AA, Ca Salicylate, TBN 350) | 232 ± 5 |
| LSME + Premix (BP, AA, Mg Salicylate, TBN 345) | 280 ± 5 |

What is claimed is:

1. A method for improving the resistance to oxidation of lubricating oils used to lubricate engines run on biodiesel fuels comprising adding to the lubricating oil an additive amount of a combination of one or more detergents selected from alkaline earth metal salicylate, and hydrocarbyl salicylate, and two anti-oxidants, wherein the two antioxidants are a 50:50 mixture of a hindered phenolic anti-oxidant and a hindered aminic anti-oxidant wherein the weight ratio (active ingredient) of detergent to anti-oxidant is about 1.5 to 1, wherein the one or more detergents and the two anti-oxidants are premixed prior to being added to the lubricating oil and wherein the premix is formed by weighing and adding sequentially to a stirred heat vessel at about 60 deg. C. the one or more detergents and the two anti-oxidants, and mixing in said stirred heat vessel for a time of about 90 minutes, wherein the lubricating oil is a methyl ester and wherein the premix of detergent and anti-oxidant is added to the lubricating oil in a combined amount of about 0.5 wt % (active ingredient).

2. The method of claim 1 the alkaline earth metal is magnesium or calcium and the hydrocarbyl substituent is selected from $C_4$-$C_{20}$ branched alkyl, $C_6$-$C_{20}$ aryl, $C_7$-$C_{20}$ aryl alkyl, which may be substituted with a sulfur, nitrogen or oxygen heteroatom either in the carbon skeleton or by heteroatom-containing substituent group.

3. The method of claim 2 wherein the hydrocarbyl substituent is a $C_1$ to $C_{20}$ alkyl amine.

4. The method of claim 3 wherein the alkyl amine is a $C_{12}$ primary amine wherein the nitrogen is attached to a tertiary carbon atom.

5. The method of claim 1, 2, 3 or 4 wherein the detergent is a hydrocarbyl-substituted salicylate wherein the hydrocarbyl group is a $C_{12}$ primary amine wherein the nitrogen is attached to a tertiary carbon atom or magnesium salicylate.

6. The method of claim 5 wherein the detergent is magnesium salicylate which has a TBN above 250.

7. An additive premixture comprising a combination of one or more detergents selected from alkaline earth metal salicylate, and hydrocarbyl salicylate, and two anti-oxidants, wherein the two antioxidants are a 50:50 mixture of a hindered phenolic anti-oxidant and a hindered aminic anti-oxidant wherein the weight ratio (active ingredient) of detergent to anti-oxidant is about 1.5:1, wherein the additive premixture is prepared by premixing the one or more detergents and the two anti-oxidants by weighing and adding sequentially to a stirred heat vessel at about 60 deg. C. the one or more detergents and the two anti-oxidants, and mixing in said stirred heat vessel for a time of about 90 minutes to yield an anti-oxidant/detergent complex, and wherein the additive premixture at about 0.5 wt % yields an improved oxidative resistance in methyl ester based lubricating oils used to lubricate engines run on biodiesel fuels in comparison to lubricating oils using the same combination of one or more detergents and two antioxidants that are not premixed.

8. The premixture of claim 7 wherein the detergent is a hydrocarbyl-substituted salicylate.

9. The premixture of claim 8 wherein the hydrocarhyl substituent is a $C_1$ to $C_{20}$ alkyl amine.

10. The premixture of claim 9 wherein the alkyl amine is a $C_{12}$ primary amine wherein the nitrogen is attached to a tertiary carbon atom.

11. The premixture of claim 7 wherein the detergent is magnesium salicylate which has a TBN above 250.

* * * * *